US006540036B1

(12) United States Patent
Sugano

(10) Patent No.: US 6,540,036 B1
(45) Date of Patent: Apr. 1, 2003

(54) CONSTRUCTION MACHINE

(75) Inventor: Takao Sugano, Ogaki (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/679,618

(22) Filed: Oct. 5, 2000

(30) Foreign Application Priority Data

Oct. 7, 1999 (JP) ..... 11-286905

(51) Int. Cl.[7] ..... B62D 33/067
(52) U.S. Cl. ..... 180/68.1; 180/68.4; 180/69.2
(58) Field of Search ..... 180/68.1, 68.2, 180/68.4, 69.2

(56) References Cited

U.S. PATENT DOCUMENTS

| | | | | | |
|---|---|---|---|---|---|
| 3,788,418 | A | * | 1/1974 | Clancy et al. | 180/68 |
| 3,907,053 | A | | 9/1975 | Savage | |
| 3,921,603 | A | * | 11/1975 | Bentz et al. | 123/41.33 |
| 4,770,427 | A | | 9/1988 | Howell et al. | |
| 5,671,820 | A | * | 9/1997 | Kobayashi et al. | 180/68.1 |
| 5,816,350 | A | * | 10/1998 | Akira et al. | 180/68.1 |
| 5,816,351 | A | * | 10/1998 | Akira et al. | 180/68.1 |
| 6,129,056 | A | * | 10/2000 | Skeel et al. | 123/41.49 |
| 6,257,359 | B1 | * | 7/2001 | Granlund et al. | 180/68.1 |
| 2001/0007292 | A1 | * | 7/2001 | Yabf | 180/68.1 |

FOREIGN PATENT DOCUMENTS

| | | | | |
|---|---|---|---|---|
| DE | 19856375 | | 6/1999 | |
| EP | 0412423 | | 2/1991 | |
| JP | 05-193377 | | 8/1993 | |
| JP | 6-227267 A | * | 6/1994 | B60K/11/04 |
| JP | 6-67556 | | 9/1994 | |
| JP | 8-277713 | | 10/1996 | |
| JP | 10-30255 | | 2/1998 | |
| JP | 10-331196 | | 12/1998 | |
| JP | 11-1939 | | 1/1999 | |
| JP | 11-303135 | | 11/1999 | |
| JP | 11-324014 | | 11/1999 | |

* cited by examiner

*Primary Examiner*—Brian L. Johnson
*Assistant Examiner*—J. Allen Shriver
(74) *Attorney, Agent, or Firm*—Oblon, Spivak, McClelland, Maier & Neustadt, P.C.

(57) ABSTRACT

A construction machine comprising: an engine received within a body cover of the construction machine; a hydraulic pump connected to an output shaft of the engine; a cooling fan for taking cooling air into the body cover; and a plurality of devices to be cooled gathered and arranged in the vicinity of the hydraulic pump, said devices being arranged so that a cooling air passage parallel with the direction of an output shaft is formed between the devices. Thereby, the cooling efficiency can be enhanced, and the body can be made compact.

6 Claims, 3 Drawing Sheets

CONSTRUCTION MACHINE

BACKGROUND OF THE INVENTION

1. Field of the Invention

The present invention relates to a construction machine having a cooling construction for cooling an engine and hydraulic devices, and particularly to a compact hydraulic excavator.

2. Description of the Related Art

In the past, in a hydraulic excavator as a construction machine, a hydraulic pump for supplying pressure oil to a hydraulic driving system such as a work attachment is driven by an engine. A radiator is provided to cool the engine. Radiation devices, for example, such as a hydraulic pump and a working oil tank other then the engine are air cooled by placing cooling air taken in from outside by operation of a cooling fan in contact therewith.

More specifically, a so-called pusher fan type cooling construction having a cooling fan arranged upstream the radiator will be described. In this cooling construction, cooling air taken into a body cover by operation of the cooling fan is introduced into the radiator and is placed in contact with the hydraulic devices also. Cooling air risen in temperature by heat exchange between the radiator and the hydraulic devices is released externally of the body cover.

However, in a compact hydraulic excavator in which the engine is arranged directly below an operator's seat, the size of an upper frame is extremely small. Therefore, there is no room for scattering and arranging the engine and the devices. When the engine and many devices are to be installed on the upper frame whose area is limited, the devices have to be necessarily integrated in a limited area. For example, a working oil tank and a fuel tank are arranged close to each other. In this case, since a temperature of working oil rises during operation, a temperature of the working oil tank rises. The fuel tank also rises in temperature accordingly. Particularly where a fuel tank made of resin is used, when the temperature exceeds a heat resistant temperature of resin, trouble such as deformation of the tank occurs.

As described above, in the conventional compact hydraulic excavator, when the devices are integrated, the devices arranged in the vicinity of the radiation devices are thermally affected by the rise of temperature of the radiation devices. With this, the devices arranged in the vicinity thereof become risen in temperature. In order not to be affected by heat, a certain space may be provided between the devices, or only the radiation devices may be isolated thermally. However, when the space is provided between the devices, the devices cannot be gathered and arranged. As a result, the compactness at which the compact hydraulic excavator is aimed cannot be achieved. Further, the parted arrangement of only the radiation devices results in less realization in the compact hydraulic excavator restricted by a space.

SUMMARY OF THE INVENTION

It is an object of the present invention to provide a construction machine having a cooling construction capable of cooling efficiently even in a state that devices such as a working oil tank and a fuel tank are gathered and arranged, thereby realizing compactness.

The construction machine according to the present invention comprises: an engine received within a body cover of the construction machine, a hydraulic pump connected to an output shaft of the engine, a cooling fan taking cooling air into the body cover, and a plurality of devices to be cooled gathered and arranged in the vicinity of the hydraulic pump, these devices being arranged so as to form a cooling air passage parallel with the direction of the output shaft between the devices.

Since in this case, the cooling air passage provided between the devices gathered and arranged is formed in parallel with the output shaft of the engine, the cooling air taken into the body cover is guided into the cooling air passage and go around the devices. Because of this, the devices can be cooled efficiently. Further, the plurality of devices to be cooled are gathered and arranged in the vicinity of the hydraulic pump connected to the output shaft of the engine so that the cooling air may pass through the devices efficiently. Because of this, a plurality of devices can be gathered and arranged within the body cover with a limited space. Thereby, the compactness of the body can be realized.

Preferably, a cooling air intake is provided in the body cover on substantially an extending line of the cooling air passage. The arrangement of the cooling air intake may be in the vicinity of the extending line of the cooling air passage.

Since in this case, the cooling air passage is provided on substantially an extending line of the cooling air intake, the cooling air is guided into the cooling air passage smoothly.

In the present invention, the plurality of devices to be cooled comprise the cooling construction including a working oil tank, a fuel tank, and a battery.

Since in this case, even if the working oil tank, the fuel tank, and the battery are gathered and arranged, the cooling air passage is secured, radiation of the working oil tank is cooled by ventilation of cooling air. Thereby, the fuel tank and the battery arranged in the vicinity of the working oil tank can be prevented from being risen in temperature.

Further, preferably, if a cooling construction is employed in which a fuel tank and a battery are arranged on one lateral side and the other lateral side, respectively, of the working oil tank.

Since in this case, the fuel tank and the battery are arranged on each side of the working oil tank, refueling and maintenance are facilitated.

Further, preferably, if a cooling construction is employed in which a shoulder part of the working oil tank has a stepwise recess, and a battery is arranged in the recess.

In this case, the working oil tank and the battery can be combined substantially face to face. With this, the gathering rate of devices can be enhanced. Moreover, it is not necessary to provide a battery fixing bracket on the upper rotating body. With this, the number of parts can be reduced.

Further, preferably, a cooling construction is employed in which a notch part is formed so as to avoid an interference with the hydraulic pump below the working oil tank.

In this case, the working oil tank can be arranged close to the hydraulic pump to a degree not to interfere with the hydraulic pump. With this, the gathering rate of devices can be enhanced.

The aforementioned cooling construction can be applied to both a pusher fan type in which a cooling fan is arranged upstream the radiator and a suction fan type in which a cooling fan is arranged downstream the radiator. In the suction type, cooling air after being heat exchanged by the radiator is introduced into the devices to be cooled. On the other hand, in the pusher fan type, cooling air taken from outside is first introduced into the devices to be cooled, because of which the pusher fan type has an advantage that the cooling efficiency is high.

Further, the hydraulic pump according to the present invention is connected in series to an output shaft of the engine. A plurality of devices are gathered and arranged making use of a space around the hydraulic pump. The hydraulic pump is positioned opposite to the cooling fan.

DESCRIPTION OF THE PREFERRED EMBODIMENTS

Figure 1:
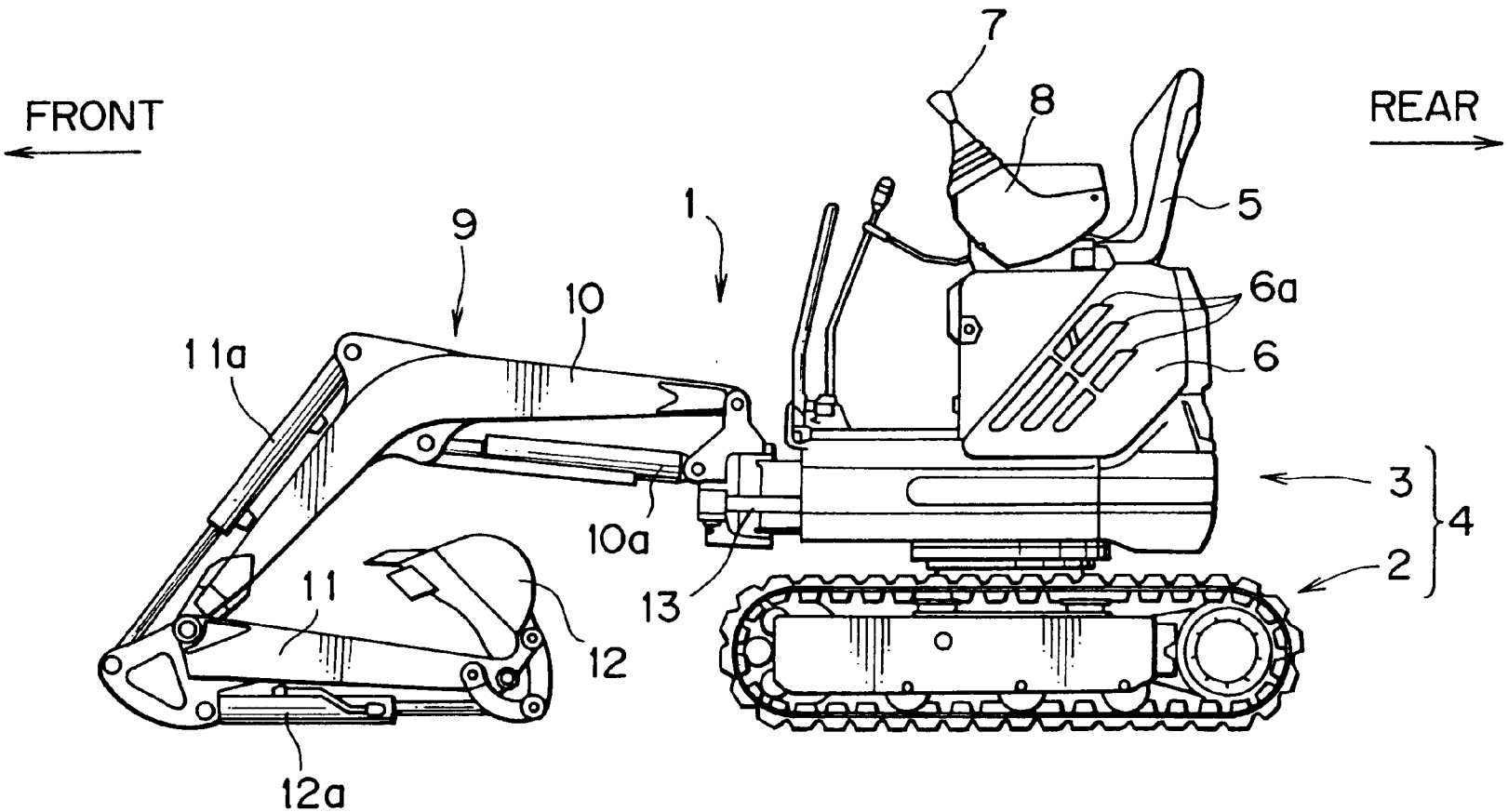
FIG. 1 is an external view of a compact hydraulic excavator to which is applied a cooling construction of a construction machine according to the present invention.

The present invention will be described in detail hereinafter with reference to the embodiments shown in the drawings.

FIG. 1 shows an external appearance of a compact hydraulic excavator to which is applied a cooling construction of a construction machine according to the present invention.

In the figure, a compact hydraulic excavator 1 has an upper rotating body 3 mounted rotatably on a crawler type traveling body 2. An excavator body 4 is constituted by them.

A cab 5 is provided on the upper rotating body 3. An engine unit and hydraulic devices not shown are received within a body cover 6 below a seat of the cabin 5. Control boxes 8 provided with an operating lever 7 are provided on both left and right sides of the cabin 5. The body cover 6 is formed on the side wall thereof with a plurality of slit-like cooling air intakes 6a for taking cooling air therein.

A work attachment 9 is mounted forward of the upper rotating body 3. The work attachment 9 comprises a boom 10 to be risen and fallen by a boom cylinder 10*a*, an arm 11 connected to an extreme end of the boom 10 and rotated by an arm cylinder 11*a*, and a bucket 12 connected to an extreme end of the arm and rotated by a bucket cylinder 12*a*. The boom 10 shown in the FIG. is constituted so as to be swung in a lateral direction about a longitudinal axis for facilitating groove excavating work. The swing operation is accomplished by expansion of a swing cylinder 13.

Figure 2:
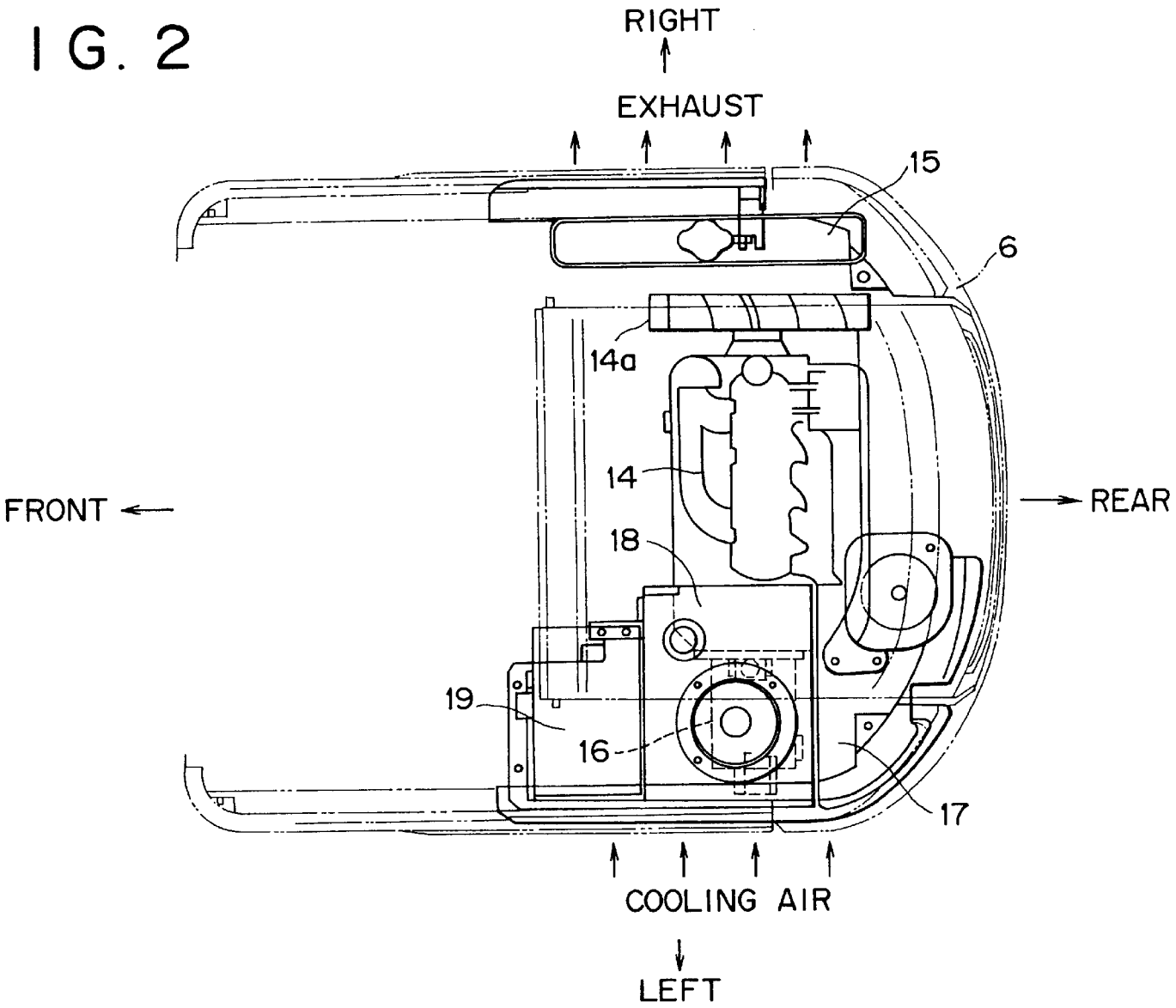
FIG. 2 is a plan view showing an arrangement of an engine, devices received within a body cover.

FIG. 2 shows an arrangement of devices within the body cover 6 shown in FIG. 1. In the FIG., an engine 14 is arranged in width direction on the upper frame of the upper rotating body 3. A cooling system in the present embodiment employs a pusher fan type. Thereby, a radiator 15 is arranged upstream a cooling fan 14*a* provided on the engine 14.

In this constitution, cooling air is taken into the body cover 6 from a cooling air intake 6*a* provided on the left side of the body. Then, when air flows toward the right side of the body through the body cover 6 and passes through the radiator 15, the air is heat exchange with engine cooling air flowing into a heat transfer pipe. Cooling air risen in temperature by the heat exchange is released outside the body cover 6.

A hydraulic pump 16 is connected in series to an output shaft of the engine 14. A plurality of devices, specifically, a fuel tank 17, a working oil tank 18, and a battery 19 are gathered and arranged so as to surround the hydraulic pump 16.

Figure 3:
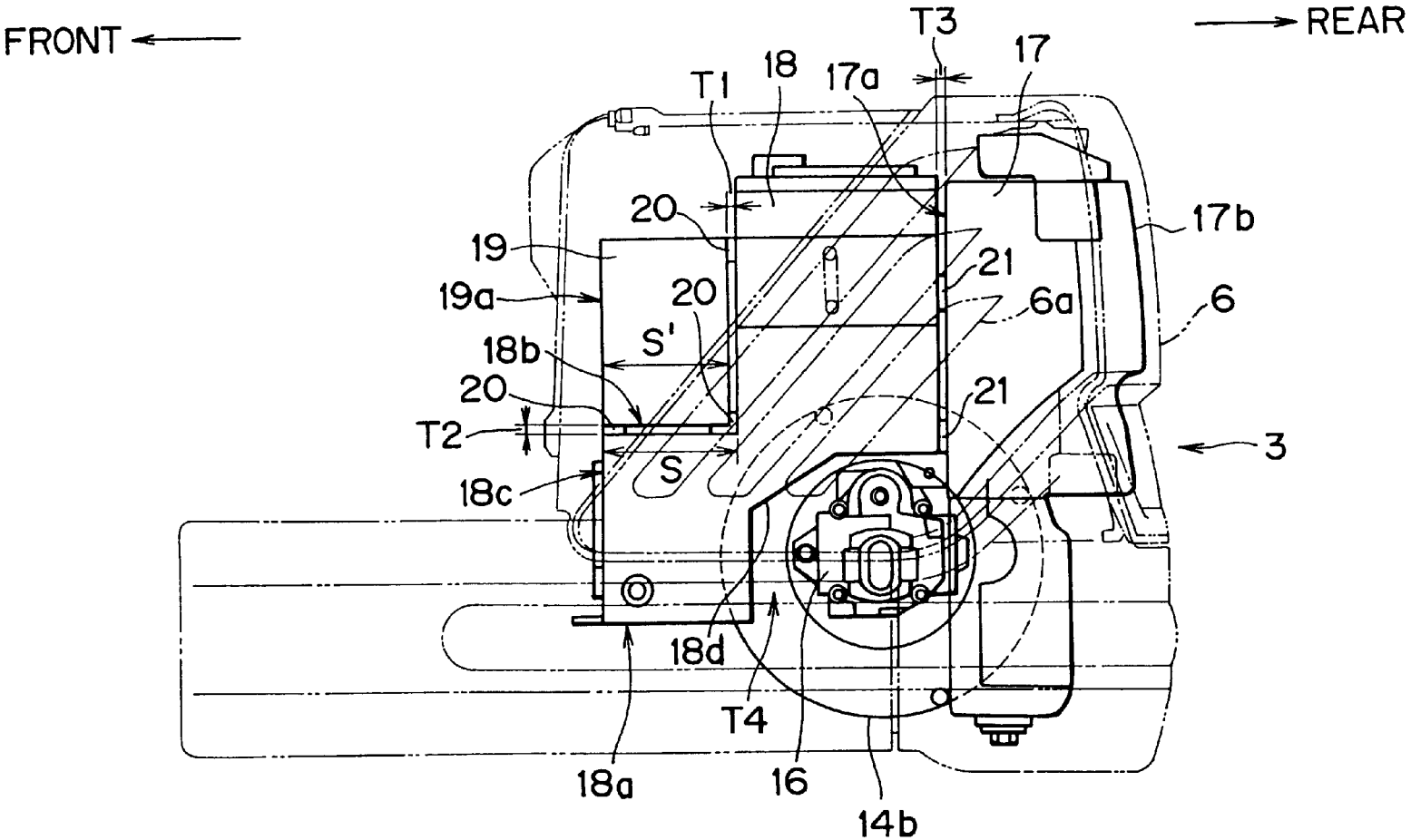
FIG. 3 is a side view showing a gathering and arranging state of devices for cooling received within the body cover.

Referring to FIG. 3, a detailed description will be made. A bracket 14*b* is provided on the output side of the engine. A hydraulic pump 16 is positioned substantially in the center thereof.

The working oil tank 18 is formed from a box made of metal and the tank has a stepwise recess. A bottom plate 18*a* of the working oil tank 18 is secured to an upper frame. In the state being secured as described, the working oil tank 18 is arranged so as to surround the above and front of the hydraulic pump 16.

A recess 18*b* is formed in a shoulder on the front side of the working oil tank 18. The dimension S in depth of the recess 18*b* is formed to be somewhat longer than the dimension S' in depth of the battery 19. Spacers 20 are attached to opposed surfaces of the working oil tank 18 and the battery 19, respectively.

Accordingly, the battery 19 is arranged in the recess 18*b* so that an outer wall 19*a* of the battery faces to an outer wall 18*c* of the working oil tank 18. In this case, a passage T1 and a passage T2 are secured between the battery 19 and the working oil tank 18.

The passages T1 and T2 are formed in parallel with the direction of the output shaft. The passages T1 and T2 will be called hereinafter a first cooling air passage.

At the lower part rearward of the working oil tank 18, a notch 18*d* is formed so as to avoid the hydraulic pump 16. Thereby, the working oil tank 18 can be arranged close to the hydraulic pump.

On the other hand, at the rear of the working oil tank 18, the fuel tank 17 is arranged close to the working oil tank 18. The fuel tank 17 is formed of resin. A spacer 21 is attached to the opposed surface 17*a* relative to the working oil tank 18. Thereby, a passage T3 is secured. The passage T3 is formed in parallel with the direction of the output shaft of the engine 14. The passage T3 will be called hereinafter a second cooling air passage.

The back surface of the fuel tank 17 is formed in the curved shape along the shape of the main body cover 6 so that the volume can be secured as large as possible (see FIG. 2, a plain view). An annular space T4 formed between the hydraulic pump 16, and the fuel tank 17 and the working oil tank 18 is called a third cooling air passage.

As described above, the fuel tank 17 and the working oil tank 18 are arranged so as to surround the hydraulic pump 16. In this case, since these tanks function as a noise insulation material, noises generated from the hydraulic pump 16 can be reduced.

The operation of the cooling construction having the above-described constitution will be explained hereinafter.

In FIG. 2, when the cooling fan 14*a* drives, cooling air is taken in from the cooling air intake 6*a*. A part of the cooling air passes through the third cooling air passage T4. Further, a part of the cooling air passes through the first cooling air passages T1 and T2. Furthermore, a part thereof passes through the second cooling air passage T3. The remaining cooling air flows externally of the devices 17, 18, 19 gathered and arranged.

The radiation of the hydraulic pump 16 and the working oil tank 18 is cooled by mainly cooling air flowing through the third cooling air passage T4.

With respect to the battery 19 not desired to be affected by the radiation, propagation of heat is cut off by cooling air flowing through the first cooling air passages T1, T2. Likewise, with respect to the fuel tank 17, propagation of heat is cut off by cooling air flowing through the second cooling air passages T3.

In the present embodiment, the fuel tank 17, the working oil tank 18 and the battery 19 are arranged close to the cooling air intake 6*a*. Because of this, cooling air is introduced into the cooling air passages T1 to T4.

The cooling air having passed through the cooling air passages T1 to T4 flows as described below similarly to the conventional pusher fan type cooling system. First, air flows along the outer wall of the engine 14. Next, after air has passed through the cooling fan 14*a* the air is introduced into the radiator 15. After engine cooling air flowing into the heat transfer pipes of the radiator 15, it is released outside the body cover 6.

In the present embodiment, the cooling construction according to the present invention has been described taking an example applied to the compact hydraulic excavator. However, the cooling construction is not limited thereto but can be applied to a suitable compact construction machine having less installation space for the engine, and the devices.

I claim:

1. A construction machine, comprising:

an engine received within a body cover of the construction machine;

a hydraulic pump connected to an output shaft of the engine;

a cooling fan for taking cooling air into said body cover; and a plurality of devices to be cooled gathered and arranged in the vicinity of said hydraulic pump, said devices including a working oil tank which at least partially overlies said hydraulic pump, and said devices being arranged so that a cooling air passage parallel with the direction of the output shaft is formed between said devices.

2. The construction machine according to claim 1, wherein said body cover has a cooling air intake in the vicinity of an extending line of said cooling air passage.

3. The construction machine according to claim 1, wherein said devices include a working oil tank, a fuel tank, and a battery.

4. The construction machine according to claim 3, wherein the fuel tank and the battery are arranged on opposite lateral sides of said working oil tank.

5. A construction machine, comprising:

an engine received within a body cover of the construction machine;

a hydraulic pump connected to an output shaft of the engine;

a cooling fan for taking cooling air into said body cover; and a plurality of devices to be cooled arranged in the vicinity of said hydraulic pump, said devices including a working oil tank, a fuel tank and a battery, said devices being arranged so that a cooling air passage parallel with the direction of the output shaft is formed between said devices, wherein said working oil tank has a recess in a shoulder of the tank, and the battery is arranged in said recess.

6. A construction machine, comprising:

an engine received within a body cover of the construction machine;

a hydraulic pump connected to an output shaft of the engine;

a cooling fan for taking cooling air into said body cover; and a plurality of devices to be cooled arranged in the vicinity of said hydraulic pump, said devices including a working oil tank, a fuel tank and a battery, said devices being arranged so that a cooling air passage parallel with the direction of the output shaft is formed between said devices, wherein said working oil tank has a notch at a lower portion of the tank so as not to interfere with said hydraulic pump.

* * * * *